US006684577B2

(12) United States Patent
Dimitrijevic

(10) Patent No.: US 6,684,577 B2
(45) Date of Patent: Feb. 3, 2004

(54) SUPPORT SYSTEM FOR LIFTING AND LEVELING EXISTING BUILDINGS THAT UTILIZES NON-CYLINDRICAL SUPPORT SECTIONS AND A VERTICALLY-ADJUSTABLE CAP THAT ENABLES THE BUILDING TO BE EASILY RAISED OR LOWERED TO A DESIRED HEIGHT

(76) Inventor: Mark Dimitrijevic, 8328 Myrtle La., Middletown, OH (US) 45044

( * ) Notice: Subject to any disclaimer, the term of this patent is extended or adjusted under 35 U.S.C. 154(b) by 0 days.

(21) Appl. No.: 10/047,948

(22) Filed: Jan. 14, 2002

(65) Prior Publication Data

US 2002/0184834 A1 Dec. 12, 2002

Related U.S. Application Data

(63) Continuation-in-part of application No. 09/800,388, filed on Mar. 6, 2001, and a continuation-in-part of application No. 09/800,350, filed on Mar. 6, 2001, now abandoned, and a continuation-in-part of application No. 09/799,452, filed on Mar. 6, 2001.

(60) Provisional application No. 60/252,814, filed on Nov. 22, 2000.

(51) Int. Cl.[7] ..... E04B 9/24

(52) U.S. Cl. ..... 52/126.6; 52/127.2; 52/296; 52/299; 52/741.15; 52/123.1; 248/354.1; 248/357; 254/30; 254/DIG. 4

(58) Field of Search ..... 52/64, 122.1, 125.1, 52/123.1, 126.1, 126.5, 126.6, 127.2, 169.9, 296, 299, 726.3, 729.1, 741.15, 745.04; 248/351, 354.1, 357; 254/30, DIG. 4

(56) References Cited

U.S. PATENT DOCUMENTS 2,141,107 A 12/1938 Greulich
2,708,828 A 5/1955 Pruyn
3,119,635 A 1/1964 Dealy et al.
3,126,709 A 3/1964 Dougherty
3,201,834 A 8/1965 Baittinger
3,282,001 A 11/1966 Bigalow
3,333,429 A 8/1967 Dougherty
3,468,084 A 9/1969 Vaessen
3,634,985 A 1/1972 Tipton
3,664,082 A 5/1972 Zintel
3,677,018 A 7/1972 Van Weele
3,796,055 A 3/1974 Mahony
3,796,056 A 3/1974 Dougherty
3,973,408 A 8/1976 Paverman
4,125,975 A 11/1978 Soble
4,140,427 A 2/1979 Jackson
4,257,722 A 3/1981 Nakajima
4,721,418 A 1/1988 Queen
4,854,782 A 8/1989 May
4,925,345 A 5/1990 McCown, Jr. et al.

(List continued on next page.)

*Primary Examiner*—Carl D. Friedman
*Assistant Examiner*—Yvonne M. Horton
(74) *Attorney, Agent, or Firm*—Thomas, Kayden, Horstemeyer & Risley, LLP

(57) ABSTRACT

An apparatus and a method are provided for lifting and leveling an existing building from a position underneath the existing building. At least a first non-cylindrical support section having a substantially rectangular shape and first and second ends is located within the earth at a position underneath the existing building. A vertically-adjustable cap is placed in contact with the second end of the first non-cylindrical support section. A jack is disposed on an upper surface of a lower side of the cap and raised until an upper surface of an upper side of the cap is exerting pressure against the foundation of the existing building. The jack is then raised, thereby raising the cap, until the foundation has been raised to a desired height. The cap is the locked so that it will not move in the vertical directions and the jack is lowered and removed. If the building subsequently needs to be re-leveled, raised or lowered, the cap can be unlocked and vertically adjusted to an appropriate height.

12 Claims, 11 Drawing Sheets

U.S. PATENT DOCUMENTS

| | | | |
|---|---|---|---|
| 5,246,311 | A | 9/1993 | West et al. |
| 5,336,021 | A | 8/1994 | Freeman, III |
| 5,356,241 | A | 10/1994 | Kunito |
| 5,509,237 | A | 4/1996 | Coutler |
| 5,575,591 | A | 11/1996 | Vanderklaauw |
| 5,724,781 | A | 3/1998 | Matthias et al. |
| 5,951,206 | A | 9/1999 | Gregory |
| 6,193,442 | B1 | 2/2001 | May |
| 6,379,085 | B1 | 4/2002 | Vanderklaauw |

SUPPORT SYSTEM FOR LIFTING AND LEVELING EXISTING BUILDINGS THAT UTILIZES NON-CYLINDRICAL SUPPORT SECTIONS AND A VERTICALLY-ADJUSTABLE CAP THAT ENABLES THE BUILDING TO BE EASILY RAISED OR LOWERED TO A DESIRED HEIGHT

This application is a Continuation-in-part of application Ser. No. 09/800,388 filed Mar. 6, 2001 and is a Continuation-in-part of application Ser. No. 09/800,350 filed Mar. 6, 2001, now abandoned and is a Continuation-in-part of application Ser. No. 09/799,452 filed Mar. 6, 2001 which claims benefit of Provisional application No. 60/252,814 filed Nov. 22, 2000.

TECHNICAL FIELD OF THE INVENTION

The present invention relates to a system for lifting and leveling (i.e., repairing) existing buildings that have settled unevenly or, for some other reason, have become unstable and need to be re-leveled and stabilized. More particularly, the present invention relates to a vertically-adjustable cap that is coupled to a support section of the system and that can be vertically adjusted to enable the building to be easily raised or lowered to a desired height.

BACKGROUND OF THE INVENTION

Several methods and systems have been developed and used for lifting, leveling and stabilizing existing buildings. One common technique used for re-leveling and stabilizing buildings and houses is accomplished by digging a hole underneath a building foundation to a depth generally equal to the length of a cylindrical cement support piling (e.g., 12 inches), driving the cylindrical cement support pilings into the ground one on top of the other until a particular depth has been reached, and jacking a portion of the building up to a particular height by utilizing a jack that is located on the top surface of the uppermost piling.

The pilings are typically driven into the ground until a rock strata is encountered or until the depth of the hole containing the pilings is believed to be sufficiently deep. In situations where a rock strata cannot be reached, the pilings are typically driven to a depth great enough to cause friction between the earth and the outer surfaces of the pilings to prevent substantial movement of the pilings.

One of the problems associated with using this approach is that the cement pilings must have relatively large diameters to provide them with sufficient strength to be driven into the ground to a particular depth and to support the building. The larger the diameter of the cement piling, the more bearing it has, which makes it more difficult to drive the piling into the ground. Another problem associated with using cement pilings is that they often shatter when rock strata and/or tree roots are encountered. For all of these reasons, this type of support system is undesirable.

Another common technique for re-leveling and stabilizing buildings utilizes steel cylindrical pipe sections that are driven into the earth adjacent the side of the building until a sufficient depth is reached. The building foundation is then jacked up using a hydraulic jack to a desired height, and then the foundation is bracketed to the uppermost steel pipe section. The jack is then removed and the building is supported and stabilized by the support system. One of the benefits of using hollow steel pipe sections for this purpose is that they have less bearing than the aforementioned concrete pilings due to the fact that the steel pipe support sections are smaller in diameter than the concrete pilings. Also, steel pipe used for this purpose is normally stronger than concrete and therefore is unlikely to break when rock or tree roots are encountered. However, the steel pipe support sections may bend, which results in instability in the support structure.

One of the disadvantages of using hollow steel pipes for this purpose is that the smaller diameter results in overall less friction between the earth and the surfaces of the steel pipe sections. Also, steel pipes, even if they are galvanized, tend to rust due to water collecting within the pipes after the system has been installed. Furthermore, bracketing the steel-pipe support system to the side of the building foundation tends to exert undesirable pressure on the outside of the building, which can result in structural damage to the building.

Another disadvantage of existing systems for lifting and leveling buildings is that such systems generally are not adjustable. For example, once the building has been jacked up to a desired height, a top cap of some sort is typically inserted between the top of the support structure and the foundation of the building. The top cap is not vertically adjustable. Therefore, in the event that the building later needs lifting, leveling or lowering, none of these tasks can be easily accomplished. Accordingly, a need exists for a system for lifting and leveling (and possibly lowering) buildings that enables the building to be easily adjusted during and/or after installation of the support system.

SUMMARY OF THE INVENTION

Accordingly, it would be desirable to provide a method and an apparatus for lifting and leveling existing buildings that overcome the aforementioned problems associated with existing support systems. The present invention provides a method and an apparatus for lifting and leveling existing buildings by utilizing a support system that lifts and levels an existing building from underneath the building utilizing non-cylindrical support sections. The apparatus of the present invention comprises at least one non-cylindrical support section that is substantially rectangular in shape and has first and second ends. The non-cylindrical support section is, in accordance with the method of the present invention, driven into the earth at a position underneath the existing building such that the first end of the first non-cylindrical support section is located beneath the second end of the first non-cylindrical support section. A vertically-adjustable cap is then placed in contact with the second end of the non-cylindrical support section. A jack is disposed on a lower surface of the cap and the vertically-adjustable cap is jacked up until the top end of the jack has pressed an upper surface of the cap against the lower surface of the building foundation. The jack is then further raised until the vertically-adjustable cap has raised the building foundation to a suitable height. The vertically-adjustable cap is then locked into place and the jack is lowered and removed.

If, in the future, the building supported by the apparatus of the present invention needs further stabilization (i.e., raising or lowering), a jack is placed on the lower surface of the cap, the vertically-adjustable cap is jacked up until the top end of the jack is exerting pressure against the upper side of the cap, the cap is unlocked, and then the jack is raised or lowered until the building foundation is at a suitable height. The vertically-adjustable cap is then locked into place and the jack is lowered and removed.

These and other features and advantages of the present invention will become apparent from the following description drawings and claims.

DETAILED DESCRIPTION OF THE PREFERRED EMBODIMENTS

Figure 1A:
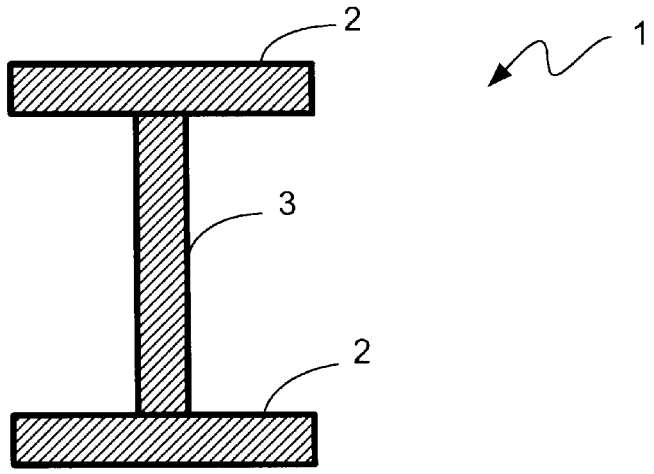
FIG. 1A is an end view of an H-beam that may be used to lift and level existing buildings in accordance with the method of the present invention.
Figure 1B:
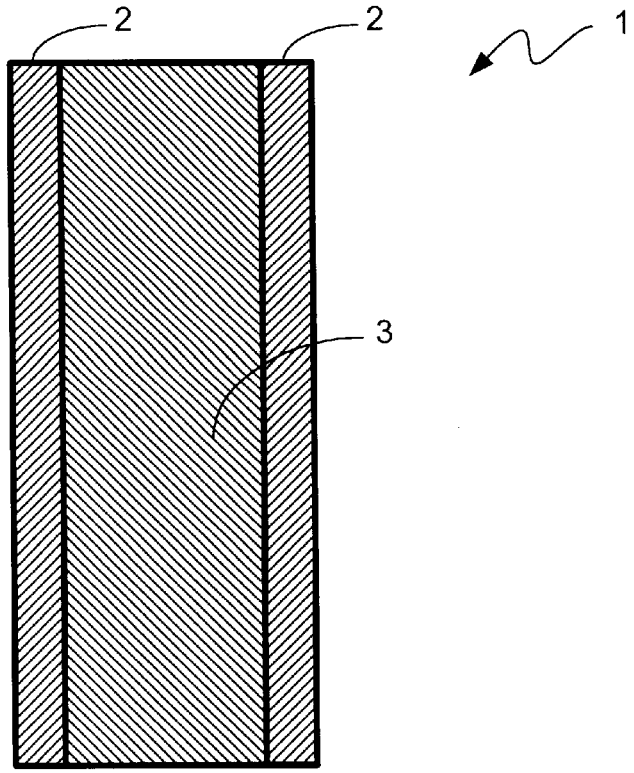
FIG. 1B is a side view of the H-beam shown in FIG. 1A.

As stated above, the present invention is directed to a method and an apparatus for lifting and leveling (i.e., repairing) existing structures, such as buildings and houses (hereinafter referred to collectively as "buildings"). The apparatus of the present invention in accordance with one embodiment comprises one or more H-beams 1, such as the H-beam shown in FIGS. 1A and 1B. FIG. 1A is a top (or bottom) view of an H-beam 1 of the type typically used in constructing large commercial buildings. FIG. 1B is a front view (or rear view) of the H-beam 1 shown in FIG. 1A. In accordance with the present invention, it has been determined the a beam having a non-cylindrical cross-section, such as a cross-section of the type shown in FIGS. 1A and 1B, for example, has decreased bearing characteristics, meaning that it can be driven into the ground easier and deeper than the concrete and steel piling sections that are currently used for lifting and leveling existing buildings.

The H-beam 1 shown in FIGS. 1A and 1B has decreased bearing characteristics due to the fact the area of the end (end view shown in FIG. 1A) of the beam 1 that is driven into the ground is less than that typically used for cement and hollow, steel pipe pilings. However, the outside area surface of the H-beam 1 (shown in FIG. 1B) is large enough to create friction between the earth and the beam 1 to help maintain the beam 1 in place once it has been installed. Therefore, the apparatus of the present invention has very desirable bearing and friction characteristics. Furthermore, the apparatus of the present invention is much stronger than steel pipes and cement pilings, and therefore has much greater stability than support apparatuses or systems comprised of steel pipes or cement pilings.

Figure 2A:
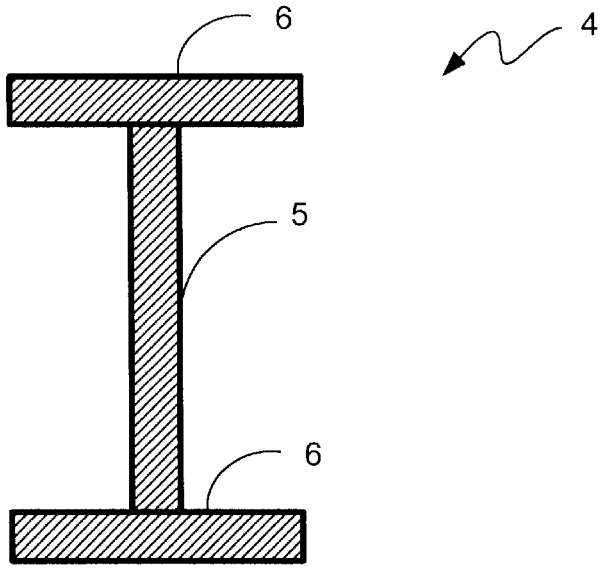
FIG. 2A is an end view of an I-beam that may be used to lift and level existing buildings in accordance with the method of the present invention.
Figure 2B:
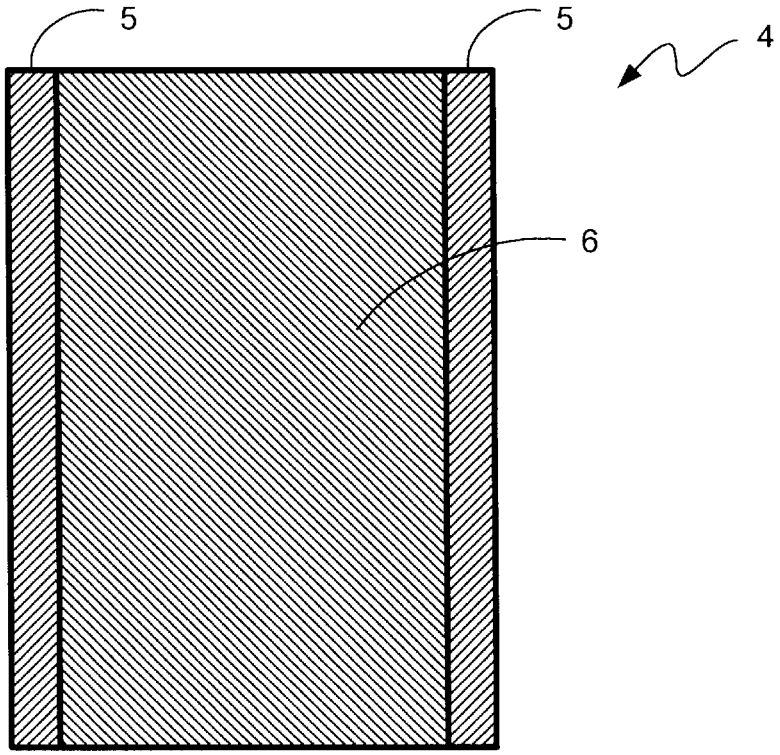
FIG. 2B is a side view of the I-beam shown in FIG. 2A.

FIGS. 2A and 2B show an alternative embodiment of the present invention in which I-beam support sections 4 are used by the support system of the present invention. The I-beam support sections 4 have similar bearing and friction characteristics as those of the H-beam 1, except that the I-beam 4 has a longer mid-section 5 that separates the top and bottom sections 6 of the I-beam 4. Those skilled in the art will understand, in view of the present disclosure, that non-cylindrical support sections other than those shown in FIGS. 1A–2B have similar bearing and friction characteristics and therefore are suitable for use with the present invention. For example, a second mid-section could be added to either of the H-beam or I-beam support sections (i.e., another section that would be parallel to mid-sections 3 or 5, respectively), or the support section could be constructed simply as a cross having to equal length perpendicular sections that intersect each other at their respective midpoints. Those skilled in the art will understand, in view of the description provided herein, the manner in which such alternative non-cylindrical support section designs could be used to achieve the goals of the present invention.

Figure 3:
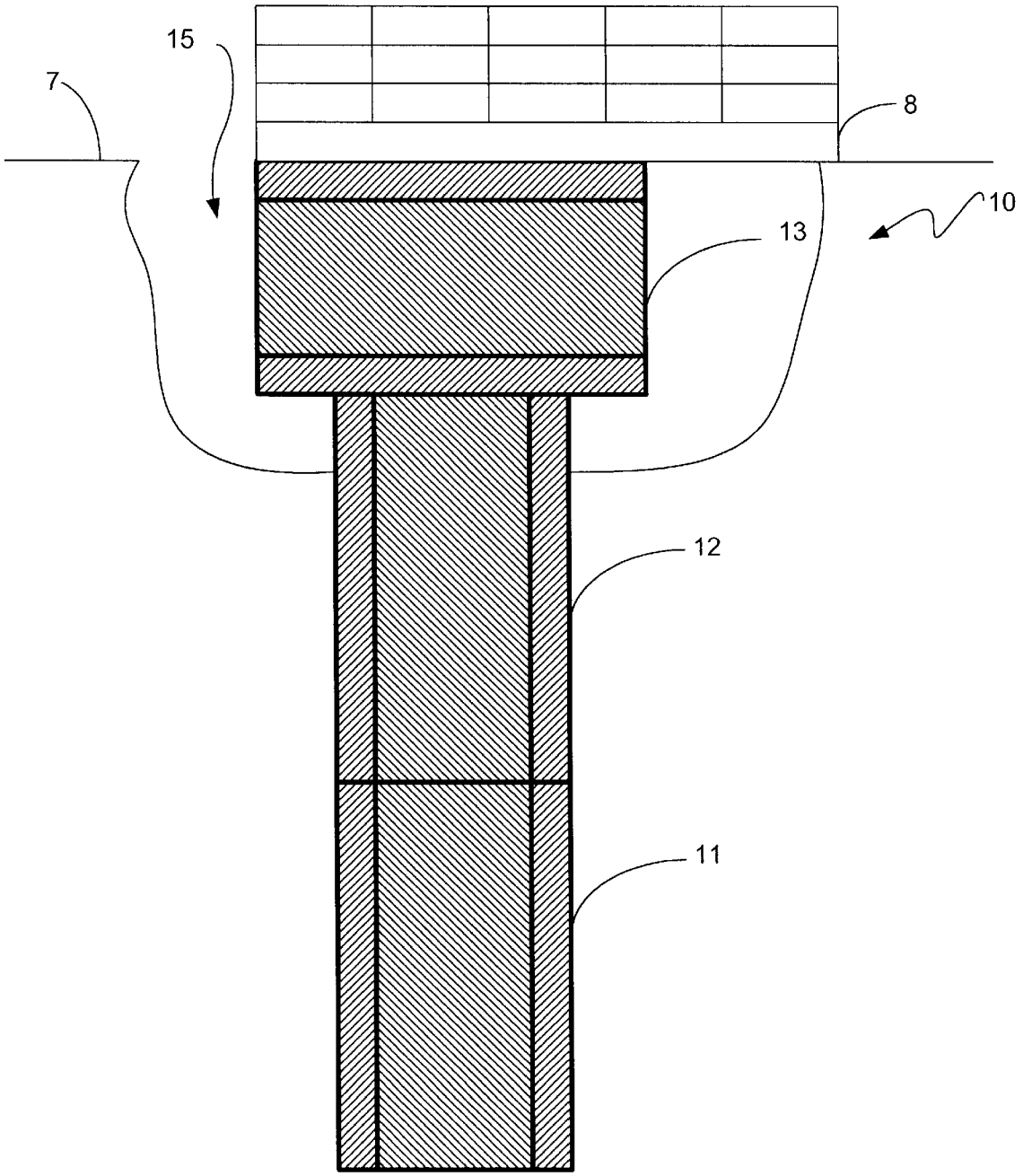
FIG. 3 is an illustration of the support system of the present invention once it has been installed to lift and level the foundation of a building.

FIG. 3 illustrates a side view of the apparatus of the present invention in accordance with one embodiment wherein the apparatus is comprised of a plurality of H-beams that are utilized in accordance with the method of the present invention to lift and level a building. The apparatus 10 is shown installed and supporting a building foundation 8 after being driven into the ground, which is represented by the numeral 7. The method for installing the apparatus 10 of the present invention will be discussed below with reference to FIG. 5.

The apparatus 10 is shown as comprising three H-beam sections 11, 12 and 13, although, in reality, many more sections will typically be required to reach a suitable depth in the earth (designated by numeral 7), e.g., until a depth is reached at which a rock strata is encountered. The support section 11 is driven into the ground through a hole 15 that has been formed in the earth (i.e., by digging) underneath the foundation 15. Once the first section 11 has been driven into the ground, the next section 12 is driven into the ground on top of the first section 11. Once a suitable depth has been reached, an H-beam support section 13 is disposed between the upper end of support section 12 and the bottom surface of the foundation 5. A jack (not shown) is then placed on the top surface of support section 13 and the building is jacked up to a suitable height to thereby lift and level the building. Friction between the apparatus 10 (i.e., support sections 11, 12 and 13) and the earth and between the apparatus 10 and the bottom surface of the foundation 5 ensures that the support system will remain stable over time.

Figure 4A:
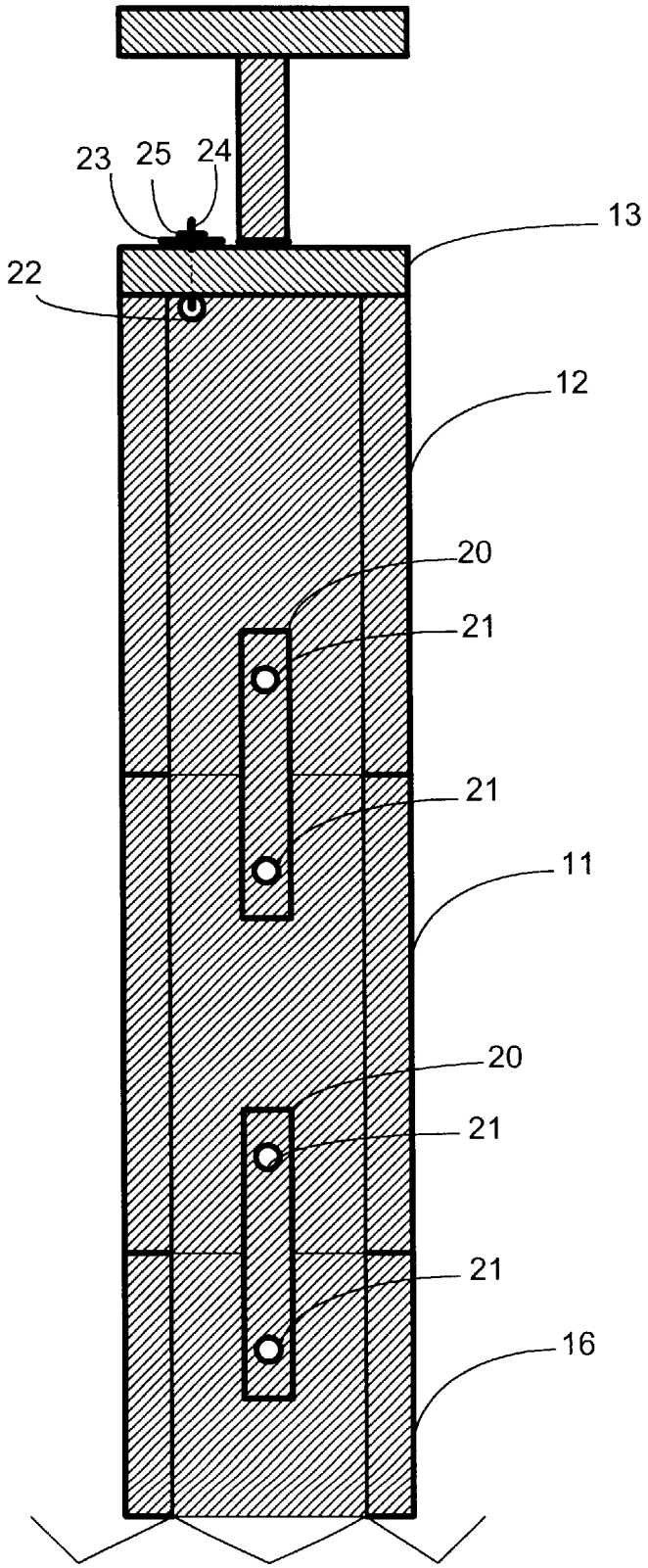
FIG. 4A illustrates a side view of the apparatus of the present invention in accordance with one embodiment for attaching the sections shown in FIGS. 1A and 1B together as they are driven into the ground.
Figure 4B:
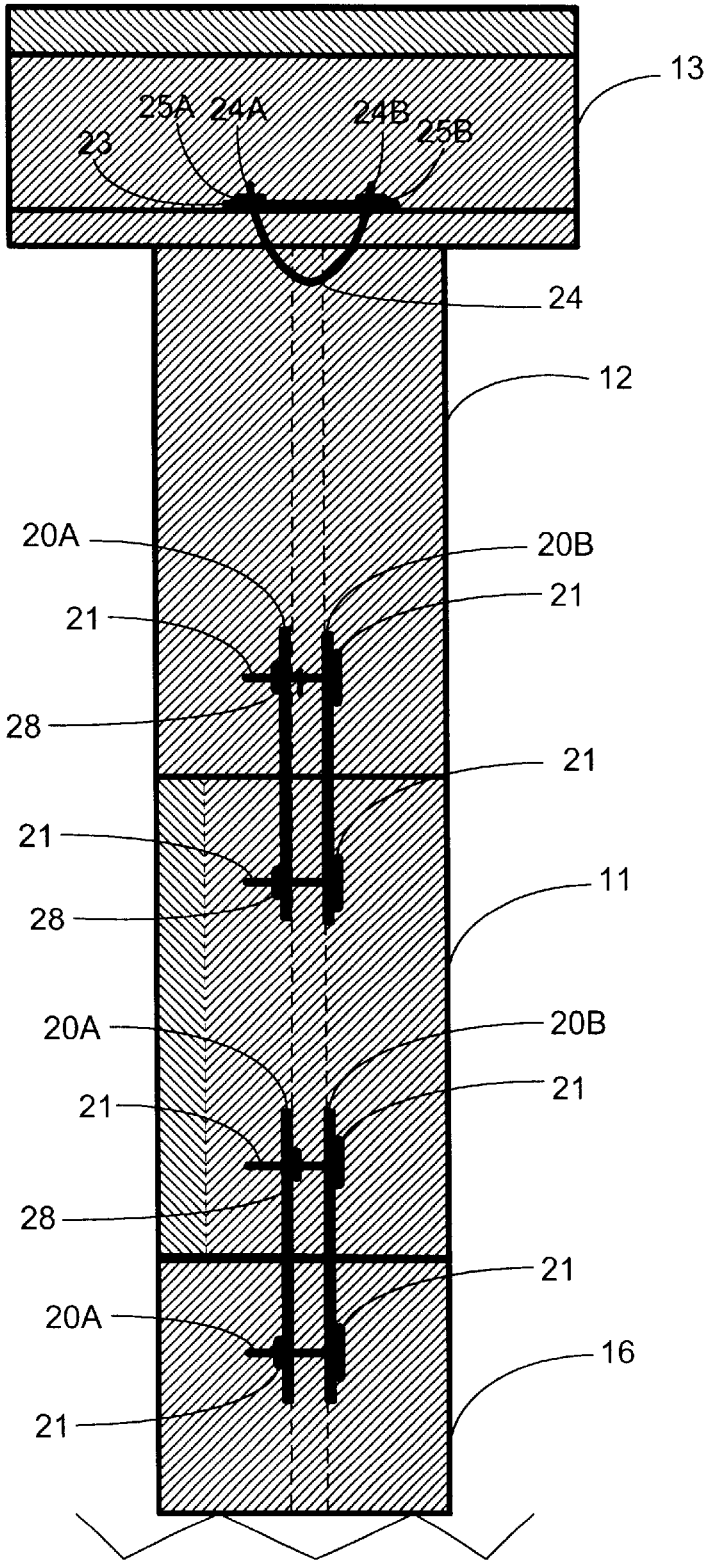
FIG. 4B illustrates a front view of the apparatus shown in FIG. 4A.

In accordance with the embodiment shown in FIG. 3, the H-beams 11, 12 and 13 comprising the apparatus are not fastened together, but are kept in place through their contact with adjacent support sections, through the downward force associated with the weight of the building and though the settling of the soil about the support sections 11 and 12. FIGS. 4A and 4B illustrate side and front views, respectively, of the apparatus 10 shown in FIG. 3 further comprising fastening devices that are utilized to fasten adjacent support sections together, and further comprising a fourth support section 16, which is shown for the purposes of clearly demonstrating the manner in which the support sections can be fastened together in accordance with one embodiment. Although it is not necessary that adjacent support sections be fastened together, fastening adjacent support sections together in the manner shown in FIGS. 4A and 4B enhances stability and further ensures that the apparatus 10, once installed, will not shift, bend, etc. over time.

In accordance with one embodiment, a first type of fastening device is used for fastening the lower support sections (16/11 and 11/12) together and a second type of fastening device is used for fastening the top two support sections (12/13) together. The first type of fastening device is comprised of a plate 20 located on opposing sides of the support sections (only front side shown in FIG. 4A), bolts 21, and nuts (not shown). The bolts 21 pass through openings formed in the plates 20 and the plates 20 on each side of the support section are pulled tightly against the support section by nuts that are fastened to the ends of the bolts 21. With respect to the top two support sections, the second type of fastening device is comprised of a U-bolt (FIG. 4B) that passes through an opening 22 formed in a location in the second-from-the-top upper support section (12) and through two openings (FIG. 4B) formed in the top support section 13. A plate 23 similar in design to plate 20 has openings formed therein through which the ends 24 of the U-bolt pass, which have nuts 25 fastened thereto to pull the two support sections 12 and 13 together.

FIG. 4B is a front view of the apparatus 10 shown in FIG. 4A. The view provided in FIG. 4B illustrates the bolt 21 passing through two plates 20A and 20B, and a nut 28 fastened to the end of the bolt 21 to thereby pull the plates toward each other, which, in turn, fastens ends of adjacent support sections together. The two plates comprised by any given fastening device of the first type are collectively represented by a thick dark line, which is labeled 20A and 20B. It will be understood by those skilled in the art, in view of the present disclosure, that the many fastening device configurations can be used to accomplish the task of coupling the non-cylindrical support sections together. The configuration of the fastening device of the first type is an example of one suitable design for this purpose and is not intended to represent the only suitable design for this purpose. Those skilled in the art will understand, in view of the present disclosure, that this task can be accomplished in virtually an unlimited number of ways.

FIG. 4B also illustrates the configuration of the second type of fastening device, which is used for coupling the top and second-to-the-top support sections 12 and 13, respectively, together. This view shows the U-bolt 24 having ends 24A and 24B that pass through an opening (FIG. 4A, item 22) formed in the mid-portion of support section 12, through two openings (not shown) formed in the top support section 13 and through openings (not shown) formed in a plate 23. The ends 24A and 24B of the U-bolt 24 have nuts 25A and 25B, respectively, fastened thereto, thereby locking support sections 12 and 13 together. As with the first type of fastening device, the fastening device utilized for coupling the non-cylindrical support sections 12 and 13 together is not limited to any particular design. Those skilled in the art will understand, in view of the present disclosure, the manner in which various designs can be used for this purpose, and that these support sections can be coupled together in virtually an unlimited number of ways. Other suitable securing means that can be used in place of the first and/or second fastening device designs, include, but are not limited to, welding, utilizing sleeves, bolts, rivets, etc., in such a way that one solid piling is created that substantially eliminates or reduces the possibility of lateral and/or vertical movement of the piling, even if normal types of lateral and/or vertical movement in the earth about the piling occurs.

Figure 5:
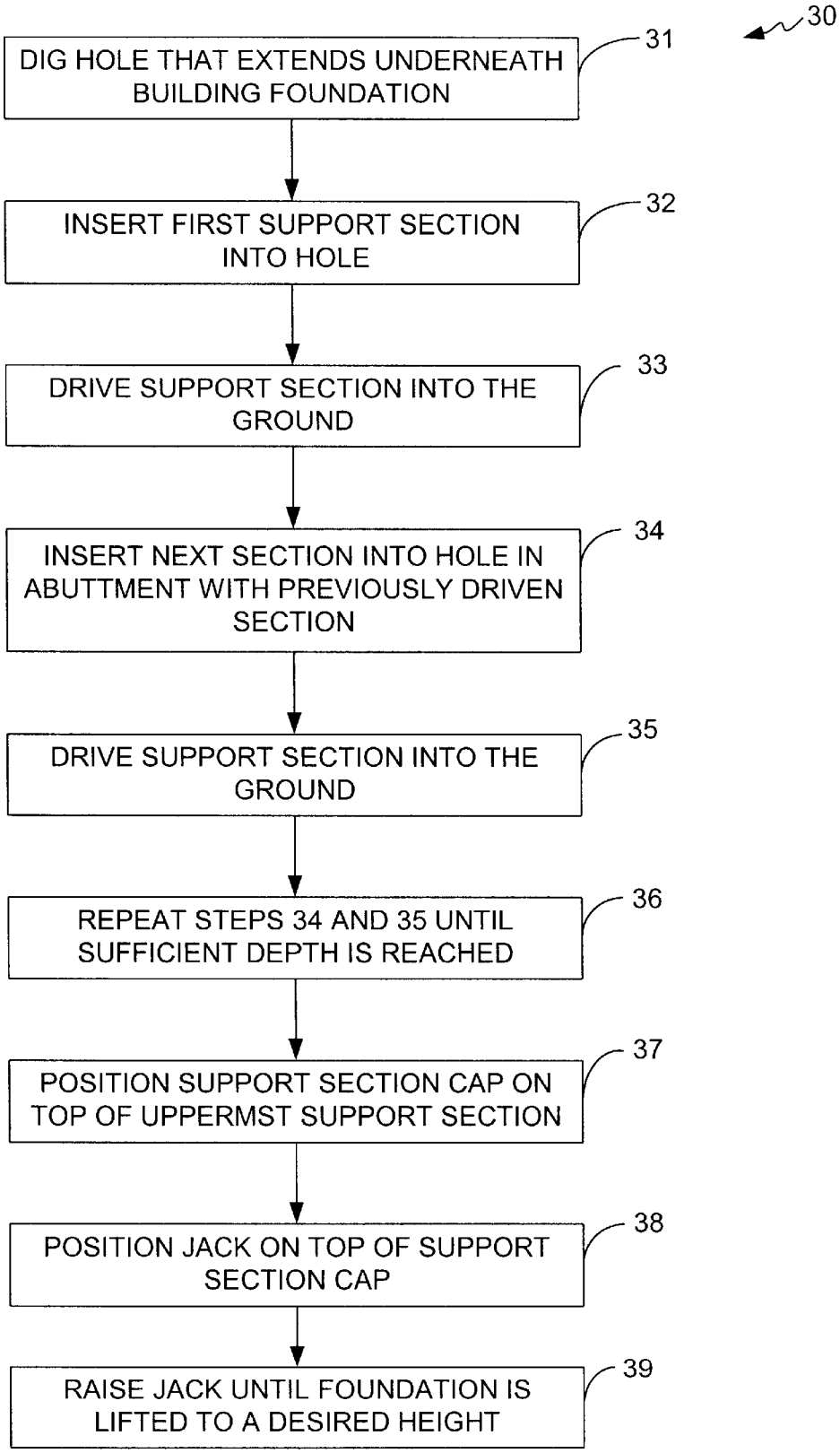
FIG. 5 is a flow chart demonstrating the method of the present invention in accordance with the one embodiment.

FIG. 5 is a flow chart illustrating the steps for performing the method 30 of the present invention in accordance with one embodiment. It should be noted that many of the steps shown in FIG. 5 do not need to be performed in the order depicted. Some steps are performed before others, but other steps may be performed in different sequences and/or simultaneously. The first step in the method depicted in the flow chart of FIG. 5 is to dig a hole that begins on the side of the building and extends underneath the building. The hole may be, for example, approximately 2 feet×2 feet wide across the top, about 4 feet deep, and extending approximately 1 foot underneath the building. This step is represented by block 31 in FIG. 5.

The next step is to press (e.g., by using a hydraulic ram) the non-cylindrical support section into the ground at the bottom of the hole, as indicated by blocks 32 and 33. The bottom end of the next support section is then placed on the top end of the lower support section and is pressed or rammed into the ground, as indicated by blocks 34 and 35. This process of driving the support sections into the ground is repeated until the non-cylindrical support sections cannot be further pressed into the ground (which typically occurs when the lower-most support section is at a depth of between 10 and 80 feet, but possibly more) and/or stable soil or rock has been reached, or simply a desired depth has been reached, as indicated by block 36. The cap support section (support section 13 in FIGS. 3–4B) is then placed on top of the uppermost support section (support section 12 in FIGS. 3–4B) as indicated by block 37. A jack, preferably a hydraulic jack, is then disposed between the cap support section and the foundation of the building and the building is lifted and leveled using the jack, as indicated by blocks 38 and 39.

Once the foundation is lifted and stabilized, another support section having a suitable length will be placed next to the jack on top of the cap support section and shimmed tight, preferably with steel shims (step not shown). The jack can then be lowered and removed.

Once these steps have been performed, the hole that was dug will be covered with dirt so that none of the piling is showing. These steps will be performed at each location(s) that needs lifting, leveling and stabilization. The length of the piling may be adjusted if further lifting/leveling is ever needed. This can be accomplished by digging down to the cap support section and following the steps discussed above (i.e., placing the jack at the proper position, re-raising the area at issue and inserting the shim).

Figure 6:
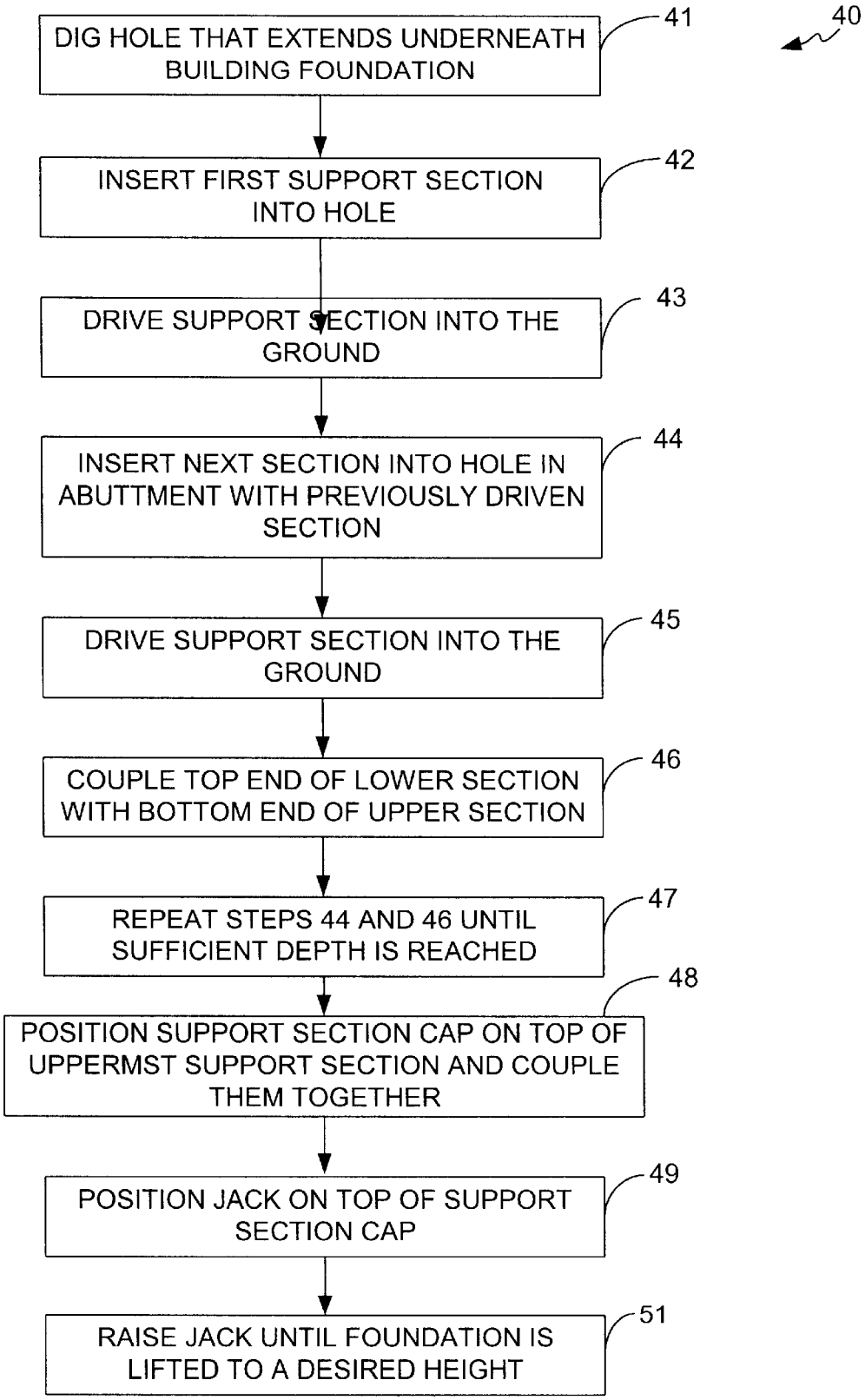
FIG. 6 is a flow chart demonstrating the method of the present invention in accordance with a second embodiment.

FIG. 6 is a flow chart illustrating the method 40 of the present invention in accordance with another embodiment, wherein the apparatus of the present invention illustrated in FIGS. 4A and 4B is utilized to lift and level an existing building. It should be noted that many of the steps shown in FIG. 6 do not need to be performed in the order depicted. Some steps are performed before others, but other steps may be performed in different sequences and/or simultaneously. The first step in the method depicted in the flow chart of FIG. 6 is to dig a hole that begins on the side of the building and extends underneath the building. The hole may be, for example, approximately 2 feet×2 feet wide across the top, about 4 feet deep, and extending approximately 1 foot underneath the building. This step is represented by block 41 in FIG. 6.

The next step is to press (e.g., by using a hydraulic ram) the non-cylindrical support section into the ground at the bottom of the hole, as indicated by blocks 42 and 43. The bottom end of the next support section is then placed on the top end of the lower support section and is pressed or rammed into the ground, as indicated by blocks 44 and 45. The support sections are then coupled together in the manner described above with reference to FIGS. 4A and 4B, as indicated by block 46. This process of driving the support sections into the ground and coupling them together is repeated until the non-cylindrical support sections cannot be further pressed into the ground (which typically occurs when the lower-most support section is at a depth of between 10 and 80 feet, but possibly more) and/or stable soil or rock has been reached, or simply until a desired depth has been reached, as indicated by block 47. The cap support section (support section 13 in FIGS. 3–4B) is then placed on top of the uppermost support section (support section 12 in FIGS. 3–4B), as indicated by block 48. A jack, preferably a hydraulic jack, is then disposed between the cap support section and the foundation of the building and the building is lifted and leveled using the jack, as indicated by blocks 49 and 51.

Once the foundation is lifted and stabilized, another support section having a suitable length will be placed next to the jack on top of the cap support section and shimmed tight, preferably with steel shims. The jack can then be lowered and removed.

Once these steps have been performed, the hole that was dug will be covered with dirt so that none of the piling is showing. These steps will be performed at each location(s) that needs lifting, leveling and stabilization. The length of the piling may be adjusted if further lifting/leveling is ever needed. This can be accomplished by digging down to the cap support section and following the steps discussed above (i.e., placing the jack at the proper position, re-raising the area at issue and inserting the shim).

Figure 7:
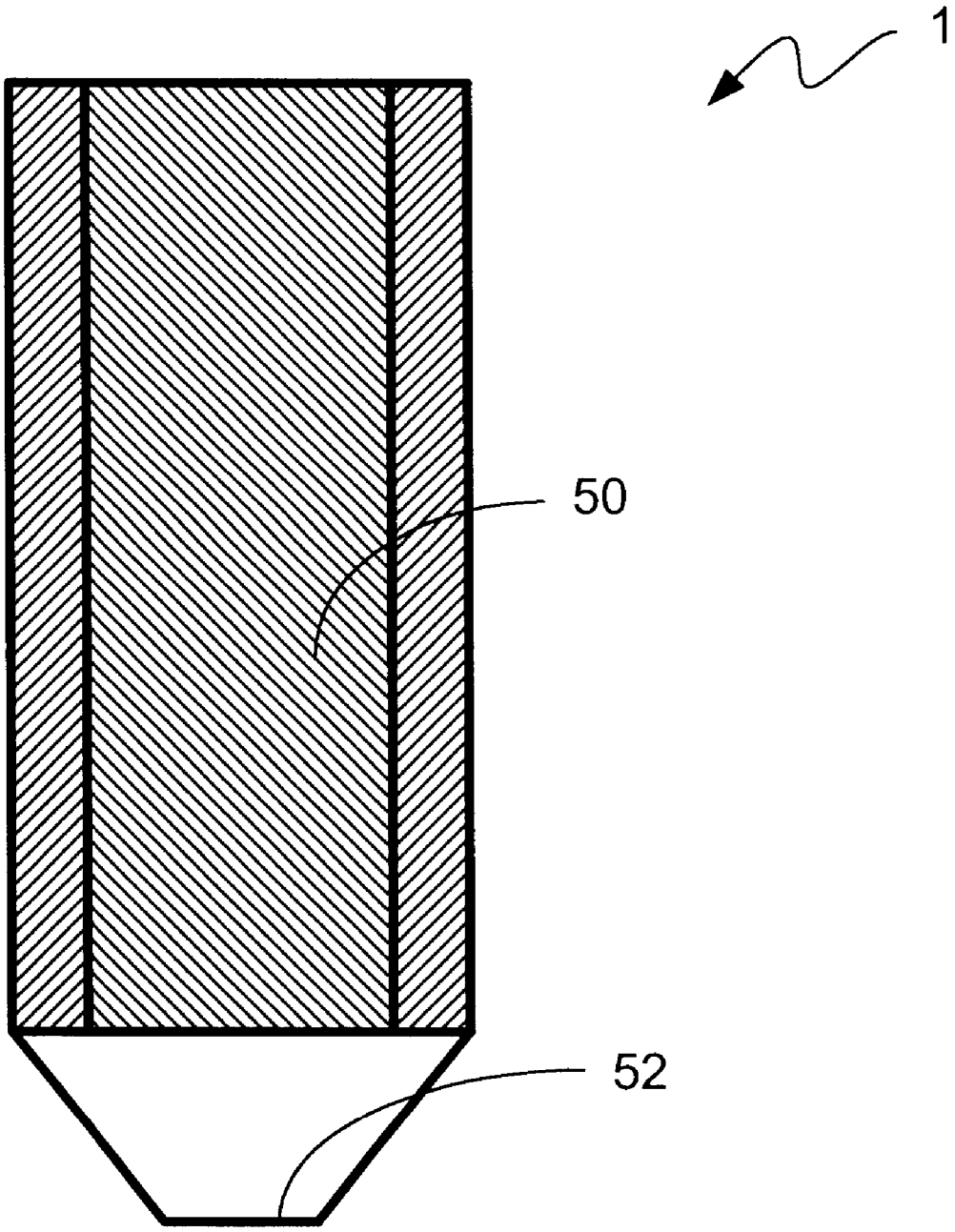
FIG. 7 is a plan view of the apparatus shown in FIG. 1B wherein the end of the apparatus is sharpened, or tapered, to further reduce bearing when the apparatus is driven into the earth in accordance with the method of the present invention.

In accordance with another embodiment of the present invention, the first support section driven into the ground as a tapered end. For example, if the apparatus of the present invention comprised a non-cylindrical support section having the shape shown in FIGS. 1A and 1B, the lowermost support section could have the shape shown in FIG. 7, which is a front view of an H-beam 50 having a tapered lower end 52. This tapered, or sharpened, lower end would result in even less bearing encountered when the piling is being installed. However, the piling would still have essentially the same desirable friction characteristics as if it were formed of support sections such as those shown in FIGS. 1A–2B.

Figure 8A:
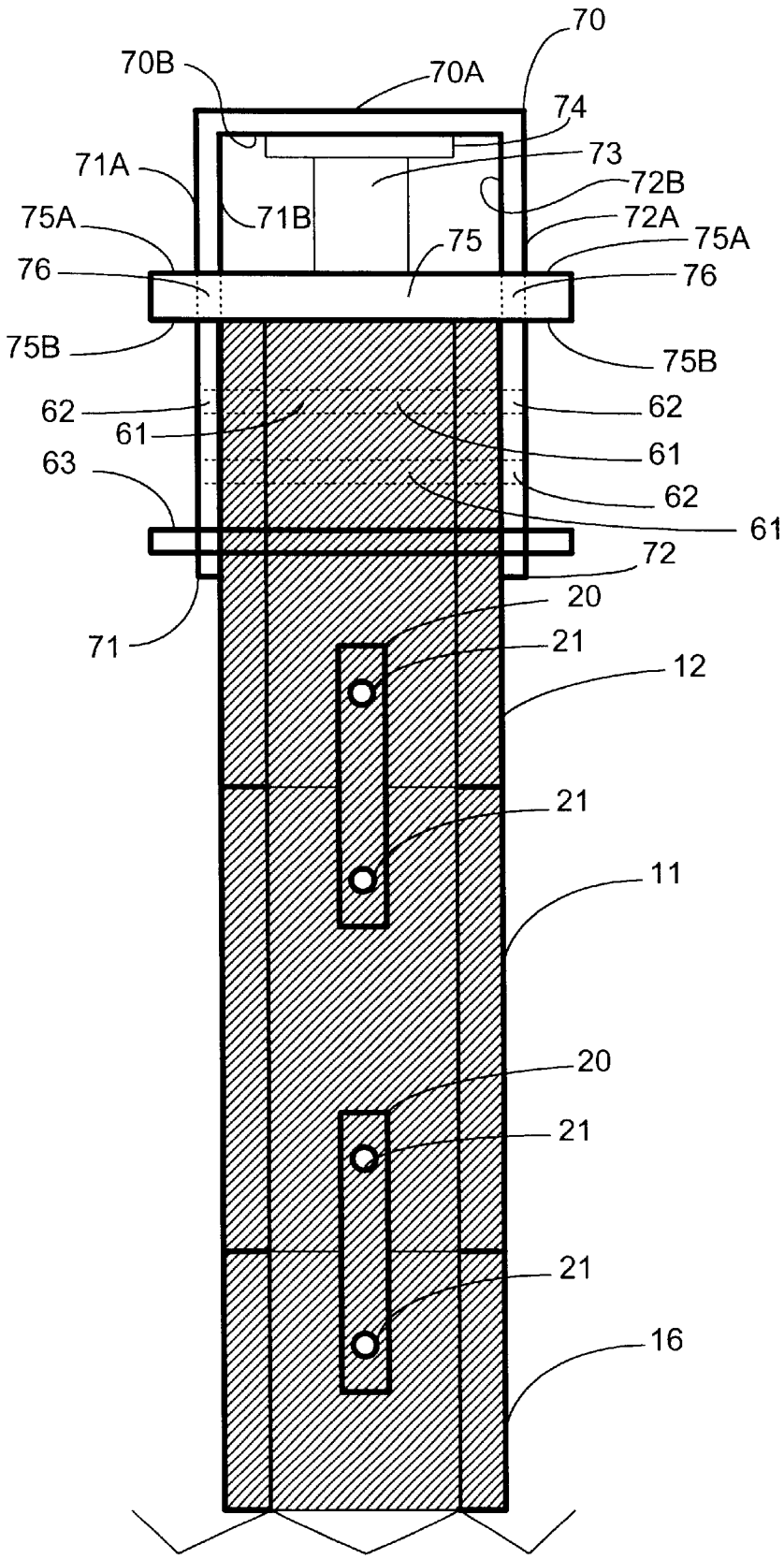
FIG. 8A is a side view of the apparatus shown in FIG. 4A with the cap replaced by the vertically-adjustable cap of the present invention.

FIG. 8A illustrates a side view of the apparatus of the present invention in accordance with the preferred embodiment. The apparatus shown in FIG. 8A is similar to the apparatus shown in FIG. 4A, except that the cap 13 shown in FIG. 4A has been replaced by the vertically-adjustable cap 70 of the present invention. The vertically-adjustable cap 70 is adjustable in the vertical direction and has a plurality of locking positions to enable the precise height at which the foundation is to be maintained to be easily chosen and easily secured. Generally, in accordance with the preferred embodiment, the adjustable support section has holes formed in it along opposite vertical sides, which, once installed, are adjacent opposite sides of the uppermost support section. The holes are formed at a plurality of different vertical positions. Similarly, the uppermost support section (i.e., the non-cylindrical support section that couples to the adjustable support section) also has holes formed through it at a plurality of vertical positions. Once the vertically-adjustable cap 70 has been jacked up to a desired height, and the holes formed in the adjustable support section are aligned with holes formed in the uppermost non-cylindrical support section, a pin or the like is inserted through the holes to thereby lock the adjustable support section in place. The manner in which the adjustable support section operates in accordance with the preferred embodiment will now be discussed with reference to FIGS. 8A, 8B and 9.

Figure 8B:
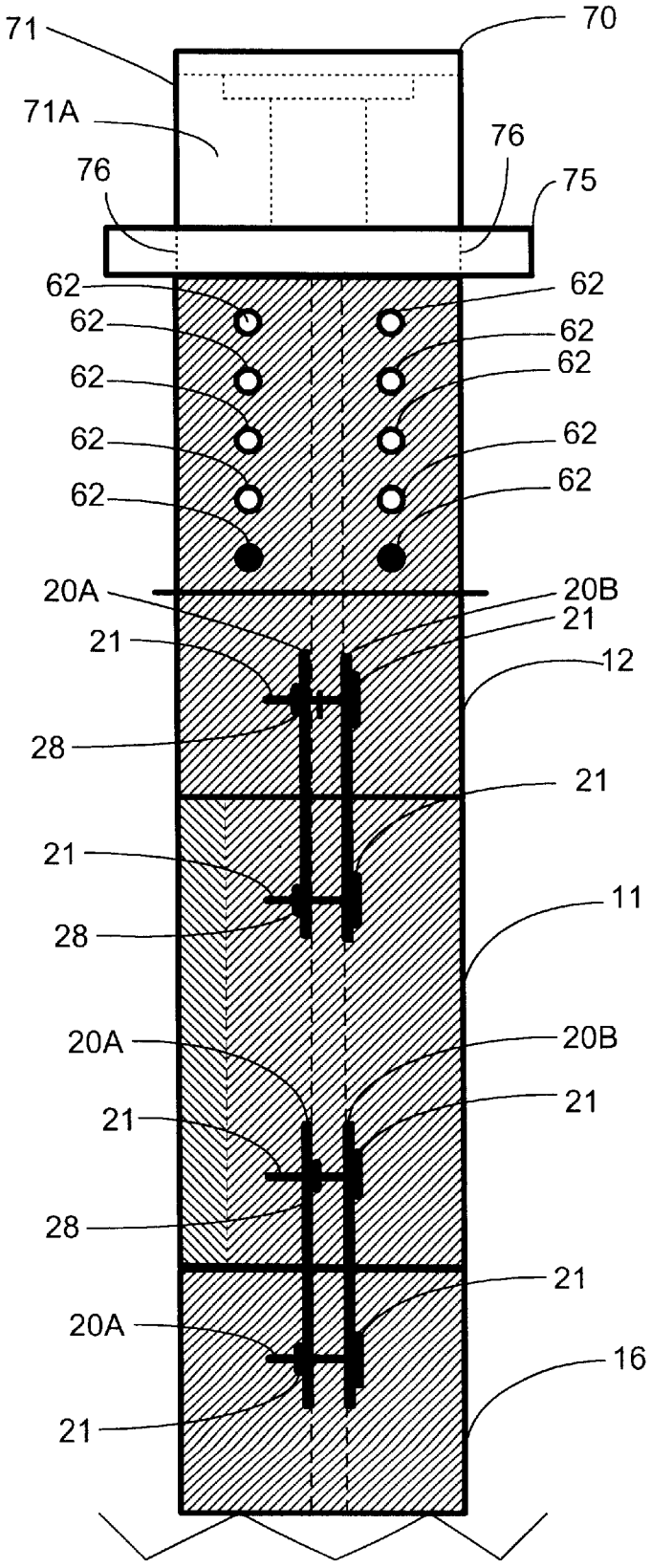
FIG. 8B is a front view of the apparatus shown in FIG. 4A with the cap replaced by the vertically-adjustable cap of the present invention.
Figure 9:
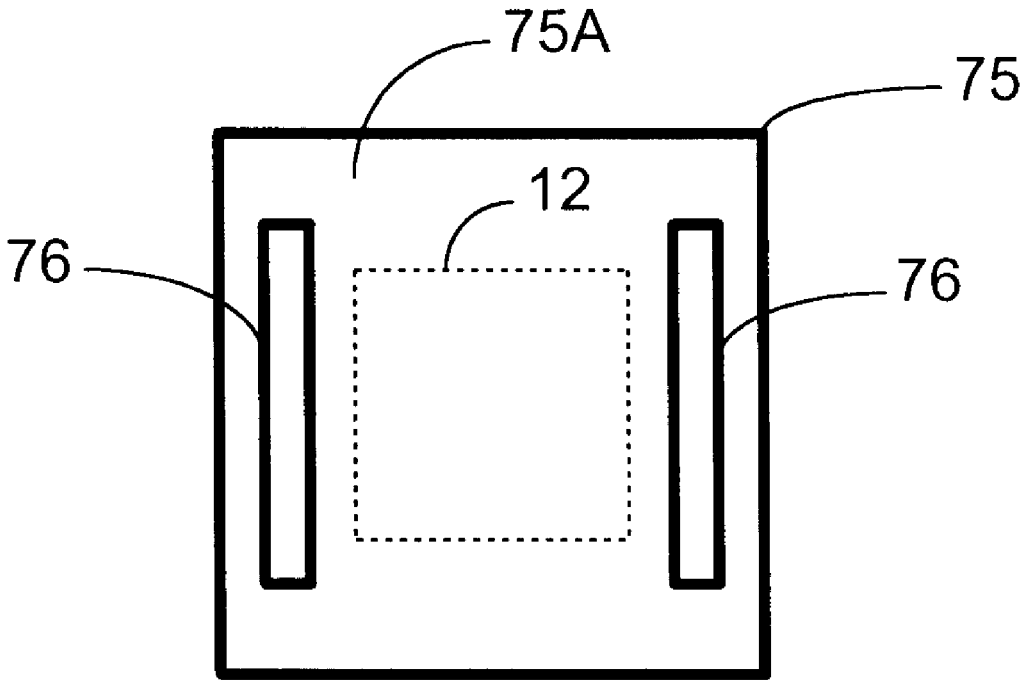
FIG. 9 is a top view of the lower end of the vertically-adjustable cap shown in FIG. 8A.

The vertically-adjustable cap 70 comprises an upper surface 70A and a lower surface 70B, a first vertical side 71 having an outer surface 71A and an inner surface 71B, a second vertical side 72 having an outer surface 72A and an inner surface 72B, and a base 75 having an upper surface 75A and a lower surface 75B, the base 75 having slots 76 formed therein for receiving the first and second vertical sides 71 and 72, respectively, in a vertically sliding engagement. A top plan view of the base 75 having the slots 76 formed therein is shown in FIG. 9. In FIGS. 8A and 8B, only a side view of the base is shown in FIGS. 8A and 8B. The first and second vertical sides 71 and 72 have openings 62 formed therein. The uppermost non-cylindrical support section 12 has holes 61 formed through it that can be aligned with the holes 62 formed in the first and second vertical sides 71 and 72. For purposes of demonstration, vertically-adjustable cap 70 is shown locked in its lowest vertical position via a pin 63 or the like, which passes through the holes 61 and 62 and is locked in place such that vertical movement of the adjustable support section 70 with respect to the support section 12 does not occur. The many ways in which the pin 63 can be locked to prevent it from sliding out once it has been installed are known to those skilled in the art. For example, the pin 63 could have a bold head on one end that is larger than the diameter of the hole 62 and threads on the other end to which nuts can be fastened. Alternatively, each end of the pin 63 could have a hole formed through it to engage a locking pin such, as a cotter pin. Therefore, a detailed discussion of the manner in which the pin 63 can be locked into place will not be provided herein.

In FIG. 8A, three different alignment positions are shown wherein the holes 61 formed through section 12 are in alignment with the holes 62 formed in the first and second vertical sides 71 and 72. However, those skilled in the art will understand, in view of the discussion provided herein, that the vertically-adjustable cap 70 can be configured or adapted to have any number of alignment positions. Furthermore, those skilled in the art will understand that there are other ways to configure vertically-adjustable cap and that the embodiment discussed with reference to FIGS. 8A–9 is only one example of the many ways that such an vertically-adjustable cap may be configured. Preferably, the vertically-adjustable cap 70 is generally rectangular in shape such that the lower surface 70B has substantially the same length and width as the cross section of the end of the non-cylindrical support section 12. Preferably, the sides 71 and 72 have substantially the same width as the sides of the non-cylindrical support sections. The type of material used to manufacture the vertically-adjustable cap 70 is not critical, but must be sufficiently strong to enable the vertically-adjustable cap 70 to function for its intended purpose, such as, for example, steel, aluminum, cast iron, etc.

FIG. 8A also illustrates a jack, which is represented by a lower portion 73 and an upper portion 74. Once the uppermost non-cylindrical support section 12 has been installed, the vertically-adjustable cap 70 is arranged on the top end of the section 12 in the manner shown in FIG. 8A and the jack 73/74 is inserted therein, such that the bottom end of the lower portion 73 of the jack is supported by the base 75 of the vertically-adjustable cap 70. The jack is then raised until the top portion 74 of it is in contact with the lower surface 70B of the vertically-adjustable cap 70. The jack is then raised until the top surface 70A is in contact with the lower surface of the building foundation (not shown). The jack is then further raised until the building foundation has been raised to a desired height that coincides with alignment a set of holes 61 and 62. The pin 63 or the like is then inserted through the holes 61/62 and locked into place. The jack may then be lowered and removed, and no substantial vertical movement of vertically-adjustable cap 70 with respect to the uppermost support section 12 will occur.

Sometimes, after a foundation has been lifted and leveled, the support structure may move for various reasons (e.g., sinking further into the earth). The vertically-adjustable cap 70 in conjunction with the apparatus of the present invention allows such problems to be easily handled by installing and raising a jack to be in contact with the lower surface 70B of the vertically-adjustable cap 70, by removing the pin 63, by using the jack to raise or lower the building foundation and then by inserting the pin 63 when the desired height has been reached.

It should be noted that while the present invention has been described with reference to the particular embodiments, it is not limited to the particular embodiments described herein. For example, although the vertically-adjustable cap 70 has been described as being substantially rectangular in shape, this is because the support sections have been described as preferably being H-beams or I-beams. It should be noted that the vertically-adjustable cap 70 could be, for example, cylindrical in shape with similar type locking mechanisms if it were intended to be used with a cylindrical type support section. Also, although a pin is shown as passing through the entire cap 70 and H or I-beam support section, a single pin or multiple pins could be used for this purpose, and it may be possible to lock the cap 70 to the support section by passing a pin through only one opening in the cap and a single aligned opening in the support structure. Also, those skilled in the art will understand that other types of locking mechanisms aside from pins and aligned openings are suitable for use with the present invention and should be construed as structural and functional equivalents. Those skilled in the art will understand, in view of the present disclosure, that modifications can be made to the embodiments described herein and that such modifications are within the scope of the present invention.

What is claimed is:

1. A method for lifting and leveling an existing building from a position underneath the existing building, the method comprising:

digging a hole in the earth, at least a portion of the hole extending underneath the building;

driving at least a first non-cylindrical support section into the earth through the portion of the hole extending underneath the building, the first non-cylindrical support section having a substantially rectangular shape, the first support section having a first end and a second end, the first end being located below the second end within the earth at said position underneath the existing building; and placing a vertically-adjustable cap on top of the second end of the first non-cylindrical support section such that a first side of said cap is in contact with the second end of said first non-cylindrical support section;

placing a jack on a second side of said cap; and raising the jack until a portion of the jack is in contact a first surface of an upper side of the vertically-adjustable cap;

raising the jack until a second surface of said upper side of said cap is in contact with a foundation of the existing building and the foundation of the building has been lifted to a desired height; and locking the vertically-adjustable cap in place once said foundation has been raised to said desired height so that the vertically-adjustable cap is not vertically adjustable.

2. The method of claim 1, wherein said first non-cylindrical support section is an H-beam.

3. The method of claim 1, wherein said first non-cylindrical support section is an I-beam.

4. An apparatus for lifting and leveling an existing building from a position underneath the existing building comprising:

a stationary member having an upper surface and a lower surface;

a vertically-adjustable member having a horizontal cap and at least two vertical sides extending from said horizontal cap, said horizontal cap having an upper surface and a lower surface, said upper surface of said horizontal cap being configured to come into contact with a building foundation, said vertical sides of said vertically-adjustable member comprising an inner surface and an outer surface, said vertically-adjustable member being vertically adjustable with reference to said stationary member;

a support section operable to be placed in the ground below a building to be lifted and leveled, said support section having a top end, a bottom end, a first side, and a second side, said first side and said second side of said support section being configured to secure said vertical sides of said vertically-adjustable member in one of a plurality of positions with respect to said support section, said top end of said support section being configured to contact said lower surface of said stationary member; and a jack disposed between the upper surface of said stationary member and the lower surface of said horizontal cap, whereby said vertically-adjustable member is raised by the jack in order to lift and level said building foundation to a desired height and said vertical sides are secured to said support section thereby locking said vertically-adjustable member at said desired height.

5. The apparatus of claim 4, wherein said support section is an H beam having a first side and an opposing second side;

wherein said vertical sides of said vertically-adjustable member comprise a first vertical side and an opposing second vertical side, said first vertical side and said second vertical side of said vertically-adjustable member being configured to be in contact with said first side and said second side, respectively, of said H-beam, when said apparatus is used for lifting and leveling.

6. The apparatus of claim 5, further comprising a pin; and wherein said first vertical side of said vertically-adjustable member has a plurality of vertically-spaced openings configured to be aligned with vertically-spaced openings in said first opposing side of said H-beam, whereby when said foundation has been raised to a desired height, the pin is placed through one of said vertically-spaced openings in said first vertical side of said vertically-adjustable member and through the aligned vertically-spaced opening in the first opposing side of said H-beam in order to lock said vertically-adjustable member into place.

7. The apparatus of claim 5, further comprising a pin; and wherein said first vertical side and said second vertical side of said vertically-adjustable member have a plurality of vertically-spaced openings therein that are arranged to be aligned with vertically-spaced openings in said first and second opposing sides of said H-beam so that, when said foundation has been raised to a desired height, the pin is placed through one of said openings in said first vertical side of said vertically-adjustable member, through an aligned one of said openings in said first opposing side of said H-beam and through an aligned one of said openings in said second opposing side of said H-beam and through an aligned one of said openings in said vertical side of said vertically-adjustable member in order to lock said vertically-adjustable member into place.

8. The apparatus of claim 5, further comprising a first and second pin; and wherein said first vertical side and said second vertical side of said vertically-adjustable member have a plurality of vertically-spaced openings therein that are arranged to be aligned with vertically-spaced openings in said first and second opposing sides of said H-beam so that, when said foundation has been raised to a desired height, the first pin is placed through one of said openings in said first vertical side of said vertically-adjustable member, through an aligned one of said openings in said first opposing side of said H-beam and the second pin is placed through one of said openings in said second vertical side of said vertically-adjustable member, through an aligned one of said openings in said second opposing side of said H-beam in order to lock said vertically-adjustable member into place.

9. The apparatus of claim 4, wherein said support section is an I-beam having a first side and an opposing second side;

wherein said vertical sides of said vertically-adjustable member comprise a first vertical side and an opposing second vertical side, said first vertical side and said second vertical side of said vertically-adjustable member being configured to be in contact with said first side and said second side, respectively, of said I-beam, when said apparatus is used for lifting and leveling.

10. The apparatus of claim 9, further comprising a pin; and wherein said first vertical side of said vertically-adjustable member has a plurality of vertically-spaced openings configured to be aligned with vertically-spaced openings in said first opposing side of said I-beam, whereby when said foundation has been raised to a desired height, the pin is placed through one of said vertically-spaced openings in said first vertical side of said vertically-adjustable member and through the aligned vertically-spaced opening in the first opposing side of said I-beam in order to lock said vertically-adjustable member into place.

11. The apparatus of claim 9, further comprising a pin; and wherein said first vertical side and said second vertical side of said vertically-adjustable member have a plurality of vertically-spaced openings therein that are arranged to be aligned with vertically-spaced openings in said first and second opposing sides of said I-beam so that, when said foundation has been raised to a desired height, the pin is placed through one of said openings in said first vertical side of said vertically-adjustable member, through an aligned one of said openings in said first opposing side of said I-beam and through an aligned one of said openings in said second opposing side of said I-beam and through an aligned one of said openings in said vertical side of said vertically-adjustable member in order to lock said vertically-adjustable member into place.

12. The apparatus of claim 9, further comprising a first and second pin; and wherein said first vertical side and said second vertical side of said vertically-adjustable member have a plurality of vertically-spaced openings therein that are arranged to be aligned with vertically-spaced openings in said first and second opposing sides of said I-beam so that, when said foundation has been raised to a desired height the first pin is placed through one of said openings in said first vertical side of said vertically-adjustable member, through an aligned one of said openings in said first opposing side of said I-beam and the second pin is placed through one of said openings in said second vertical side of said vertically-adjustable member, through an aligned one of said openings in said second opposing side of said I-beam in order to lock said vertically-adjustable member into place.

* * * * *